US010196863B2

(12) United States Patent
Liu et al.

(10) Patent No.: US 10,196,863 B2
(45) Date of Patent: Feb. 5, 2019

(54) CONNECTION STRUCTURE BETWEEN PIPE BODY AND STEEL JOINT OF ALUMINUM ALLOY DRILL PIPE

(71) Applicants: China National Petroleum Corporation, Beijing (CN); CNPC Tubular Goods Research Institute, Xi an, Shan Xi (CN)

(72) Inventors: Yonggang Liu, Beijing (CN); Xiaojun Li, Beijing (CN); Chun Feng, Beijing (CN); Fangpo Li, Beijing (CN)

(73) Assignees: China National Petroleum Corporation, Beijing (CN); CNPC Tubular Goods Research Institute, Xi an, Shan Xi (CN)

( * ) Notice: Subject to any disclaimer, the term of this patent is extended or adjusted under 35 U.S.C. 154(b) by 560 days.

(21) Appl. No.: 14/933,244

(22) Filed: Nov. 5, 2015

(65) Prior Publication Data

US 2016/0130885 A1 May 12, 2016

(30) Foreign Application Priority Data

Nov. 12, 2014 (CN) ..... 2014 1 0645836

(51) Int. Cl.
*E21B 17/042* (2006.01)

(52) U.S. Cl.
CPC ..... *E21B 17/042* (2013.01)

(58) Field of Classification Search
CPC ..... F16L 15/002; F16L 15/007; F16L 15/06; E21B 17/042
USPC ..... 285/333, 334
See application file for complete search history.

(56) References Cited

U.S. PATENT DOCUMENTS

| | | | |
|---|---|---|---|
| 4,662,659 | A | 5/1987 | Blose et al. |
| 4,676,529 | A | 6/1987 | McDonald |
| 4,828,295 | A | 5/1989 | Plaquin et al. |
| 6,347,814 | B1 | 2/2002 | Cerruti |
| 2007/0200345 | A1 | 8/2007 | Toscano et al. |

FOREIGN PATENT DOCUMENTS

| | | | |
|---|---|---|---|
| CN | 202391353 | U | 8/2012 |
| CN | 102900378 | A | 1/2013 |
| CN | 103140645 | A | 6/2013 |

(Continued)

OTHER PUBLICATIONS

First Notification of Office Action and Search Report for CN Application No. 201410645836.7, dated Jan. 20, 2016, 11 pages.

*Primary Examiner* — David Bochna
(74) *Attorney, Agent, or Firm* — Hoffman Warnick LLC

(57) ABSTRACT

A connection structure between an aluminum alloy drill pipe body and a steel joint of an aluminum alloy drill pipe includes a first joint at an end of the aluminum alloy pipe body and a steel second joint; wherein the first joint includes a first external threaded section and a second external threaded section provided from outside to inside thereof, and a major diameter of the first external threaded section is smaller than that of the second external threaded section; and wherein the second joint includes a first internal threaded section which is able to be fitted with the first external threaded section and a second internal threaded section which is able to be fitted with the second external threaded section, and a pitch diameter of the second external threaded section is larger than that of the second internal threaded section.

12 Claims, 1 Drawing Sheet

(56) References Cited

FOREIGN PATENT DOCUMENTS

| | | | |
|---|---|---|---|
| CN | 104060946 | A | 9/2014 |
| CN | 104131788 | A | 11/2014 |
| EP | 1046779 | A1 | 10/2000 |
| WO | 2012/025461 | A2 | 3/2012 |

CONNECTION STRUCTURE BETWEEN PIPE BODY AND STEEL JOINT OF ALUMINUM ALLOY DRILL PIPE

This application claims priority to Chinese Patent Application No. 201410645836.7, filed on Nov. 12, 2014 before the State Intellectual Property Office of the P.R.C, which is hereby incorporated by reference in its entirety.

TECHNICAL FIELD

The present disclosure relates to the field of threaded connection, and particularly, to a connection structure between an aluminum alloy drill pipe body and a steel joint of an aluminum alloy drill pipe.

BACKGROUND

The aluminum alloy drill pipe has advantages and characteristics such as light dead weight, high mass strength ratio, and anti-fatigue. With the application of special process wells such as super-deep wells, super-long horizontal wells and super-long extended reach wells, and the popularization of downhole power drilling tools, the aluminum alloy drill pipe is used more and more widely. According to related data statistics, in recent years, in the exploration and development of oil and gas resources in Russia, the aluminum alloy drill pipe is used in 70% of wells.

SUMMARY

A connection structure between an aluminum alloy drill pipe body and a steel joint of an aluminum alloy drill pipe, comprises a first joint located at an end of an aluminum alloy pipe body and a steel second joint; wherein the first joint comprises a first external threaded section and a second external threaded section provided from outside to inside thereof, and a major diameter of the first external threaded section is smaller than that of the second external threaded section; and wherein a cylindrical second joint comprises a first internal threaded section which is able to be fitted with the first external threaded section and a second internal threaded section which is able to be fitted with the second external threaded section, and a pitch diameter of the second external threaded section is larger than that of the second internal threaded section.

BRIEF DESCRIPTION OF THE DRAWINGS

The connection structure between an aluminum alloy drill pipe body and a steel joint of an aluminum alloy drill pipe of the present disclosure will be further described in detail with reference to the drawings.

LIST OF REFERENCE SIGNS

Figure 1:
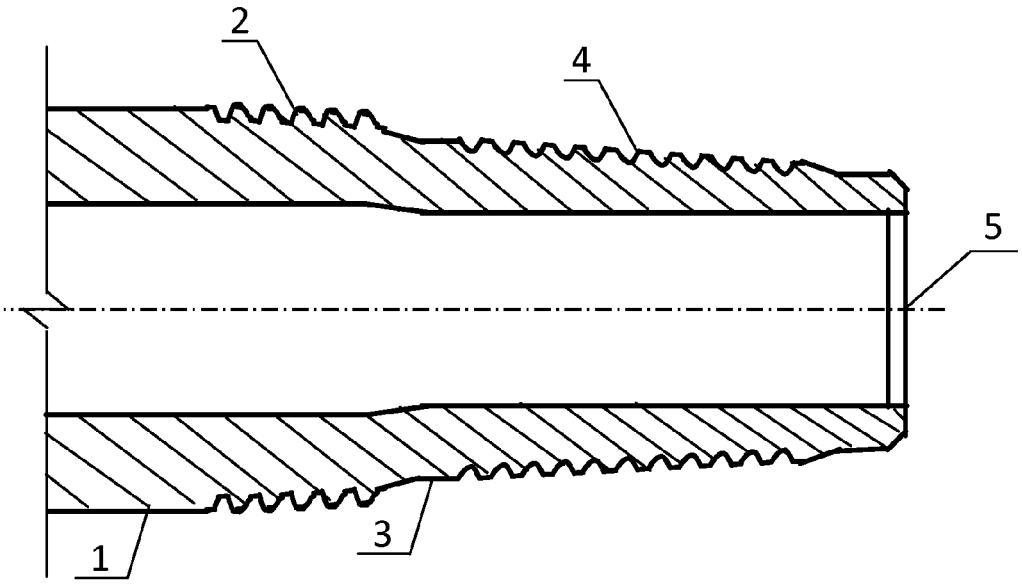
FIG. 1 is a sectional view of a first joint.

1. First Joint; 2. Second External Threaded Section; 3. External Transition Section; 4. First External Threaded Section; 5. First Seal End Face; 6. Second Joint; 7. Second Internal Threaded Section; 8. Internal Transition Section; 9. First Internal Threaded Section; 10. Second Seal End Face.

Description of Embodiments

Currently, the aluminum alloy drill pipe has two types of structures. One is an all aluminum alloy drill pipe completely made of aluminum alloy material. The other is an aluminum alloy drill pipe with a steel joint, i.e., a second joint portion is made of aluminum alloy material while the joint is made of carbon steel, and the aluminum alloy second joint is in threaded connection with the steel joint. The second joint is connected to the joint in the manner of hot assembly, i.e., when the second joint is to be connected to the joint, firstly the steel joint is heated to expand, and then the heated steel joint is in threaded connection with the aluminum alloy second joint. After the steel joint is cooled, an interference fit is formed for the threaded connection between the joint and the second joint through an effect of heat-expansion and cold-contraction of the steel, and the screwing-off torque between the aluminum alloy second joint and the steel joint is far larger than the screwing-on torque therebetween, thus any back-off or loosening of the aluminum alloy drill pipe will never occur at the connection parts of the second joint and the joint. Alternatively, the aluminum alloy second joint of the drill pipe may be cooled firstly, and then the cooled second joint is connected to the steel joint. This principle is the same as the principle that heats the steel joint and connects it to the aluminum alloy second joint, both for achieving an interference fit between the steel joint and the second joint after the connection through heat-expansion and cold-contraction of the materials, so as to obtain higher screwing off torque as well as connection strength and sealing strength between the aluminum alloy second joint and the steel joint.

Either the cold assembly or the hot assembly requires special facilities to heat or cool the joint or the second joint. In addition, either the steel joint or the aluminum alloy second joint requires a high or low temperature state during the assembly. Thus the efficiency of the assembly process is not high.

In order to solve the problem that the threaded connection between the aluminum alloy pipe body joint of the existing drilling pipe and the steel joint is easy to be at a risk of loosing or screwing off during construction works, the present disclosure provides a connection structure between an aluminum alloy pipe body of an drill pipe and a steel joint, which enables the aluminum alloy second joint and the steel joint to be assembled under the room temperature by screwing on, without requiring special facilities to heat the joint or cool the second joint. The operation is simple, the assembly efficiency can be greatly improved and the assembly cost can be reduced.

The present disclosure adopts the following technical solution to solve its technical problem: a connection structure between an aluminum alloy drill pipe body and a steel joint of an aluminum alloy drill pipe, comprising a first joint located at an end of an aluminum alloy pipe body and a steel second joint; wherein the first joint comprises a first external threaded section and a second external threaded section provided from outside to inside thereof, and a major diameter of the first external threaded section is smaller than that of the second external threaded section; and wherein a cylindrical second joint comprises a first internal threaded section which is able to be fitted with the first external threaded section and a second internal threaded section which is able to be fitted with the second external threaded section, and a pitch diameter of the second external threaded section is larger than that of the second internal threaded section.

In one embodiment, the pitch diameter of the second external threaded section may be larger than that of the second internal threaded section by 0.08 mm to 0.18 mm.

In one embodiment, threads on both the second external threaded section and the second internal threaded section may be knuckle threads.

In one embodiment, both the second external threaded section and the second internal threaded section may be tapered thread sections.

In one embodiment, both the first external threaded section and the first internal threaded section may be tapered thread sections.

In one embodiment, one end of the first internal threaded section may be connected to the second internal threaded section by an internal transition section, one end of the first external threaded section may be connected to the second external threaded section by an external transition section, and a position of the internal transition section may correspond to that of the external transition section.

In one embodiment, the internal transition section may comprise a cylindrical transition section connected to the first internal threaded section and a tapered transition section connected to the second internal threaded section, and the external transition section may be matched with the internal transition section in terms of a structure and size.

In one embodiment, the other end of the first internal threaded section may be provided with a second seal end face, and the first external threaded section may be provided outside thereof which a first seal end face matched with the second seal end face.

In one embodiment, a strength of aluminum alloy of which the first joint is made is less than that of carbon steel of which the second joint is made.

In one embodiment, when the first joint is connected to the second joint, threads of the second external threaded section of the first joint may interfere with those of the second internal threaded section of the second joint, so that thread teeth of the second external threaded section may undergo a plastic deformation, and thus the engaged threads may be bonded together and thread galling occurs. The threads of the first external threaded section of the first joint are normally engaged with those of the first internal threaded section of the second joint.

In one embodiment, after the first joint is connected to the second joint, a screwing-off torque between the first joint and the second joint is 1.5 to 2 times more than a screwing-on torque therebetween.

The present disclosure has the following beneficial effect: through the design of the primary and secondary threads in the structure, the primary threads on the steel joint realize the normal engagement between the joint and the second joint, thereby achieving the expected connection strength and sealing property between the second joint and the joint. Through the interference fit, the secondary threads create expected thread galling to achieve a higher screwing off torque. Meanwhile, the connection structure between the aluminum alloy pipe body of the drill pipe and the steel joint enables the aluminum alloy second joint and the steel joint to be assembled under the room temperature by screwing on, without requiring special facilities to heat the joint or cool the second joint. The operation is simple, the assembly efficiency can be greatly improved and the assembly cost can be reduced.

Figure 2:
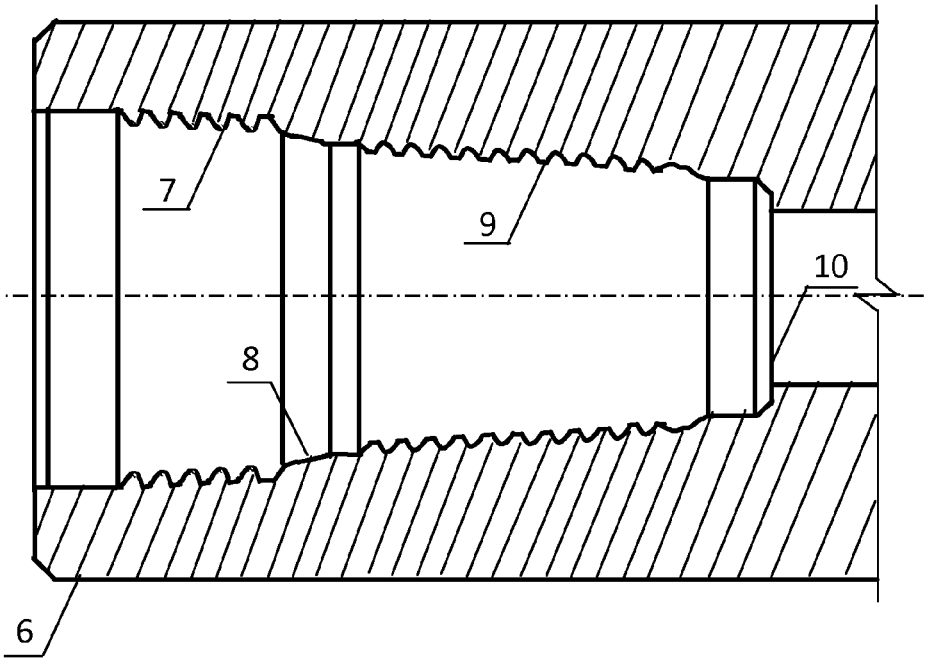
FIG. 2 is a sectional view of a second joint.

The connection structure between an aluminum alloy drill pipe body and a steel joint of an aluminum alloy drill pipe of the present disclosure will be further described in detail with reference to the drawings. The connection structure between the aluminum alloy drill pipe body and the steel joint of the aluminum alloy drill pipe, comprises a first joint 1 at an end of the aluminum alloy pipe body and a steel second joint 6; the first joint 1 comprises a first external threaded section 4 and a second external threaded section 2 provided from outside to inside (from right to left in FIG. 1) thereof, and a major diameter of the first external threaded section 4 is smaller than that of the second external threaded section 2; a cylindrical second joint 6 comprises a first internal threaded section 9 which is able to be fitted with the first external threaded section 4 and a second internal threaded section 7 which is able to be fitted with the second external threaded section 2, and a pitch diameter of the second external threaded section 2 is larger than that of the second internal threaded section 7, as shown in FIGS. 1 and 2.

When the first joint 1 and the second joint 6 are machined, the second external threaded section 2 and the second internal threaded section 7 have the same parameters except a pitch diameter thereof. Specifically, the pitch diameter of the second external threaded section 2 is larger than that of the second internal threaded section 7 by 0.08 mm to 0.18 mm. Thus the second external threaded section 2 and the second internal threaded section 7 can be fitted and connected to each other. The first external threaded section 4 is matched with the first internal threaded section 9, and thus they can also be fitted and connected to each other.

During the assembly, the first external threaded section 4 and the first internal threaded section 9 are normally engaged with each other to achieve the expected connection strength between the pipe body (first joint 1) and the joint (second joint 6). Since the pitch diameter of the second external threaded section 2 is larger than that of the second internal threaded section 7, an interference occurs in the threaded connection between the second external threaded section 2 and the second internal threaded section 7, so that thread teeth of the second external threaded section 2 undergoes a plastic deformation, and thus a bonding appears in the connection between the second external threaded section 2 and the second internal threaded section 7. That is, the plastic deformation of the thread teeth of the second external threaded section 2 destroys the complete structure of the second external threaded section 2, so that the threads encounter an interference fit for the purpose of thread galling. That is, the second external threaded section 2 will be damaged after one time of assembly, and a second assembly cannot be carried out after the second external threaded section 2 is screwed off, i.e., the first joint 1 can only be assembled or used for one time. In this embodiment, the pitch diameter of the second external threaded section 2 is larger than that of the second internal threaded section 7 by 0.08 mm to 0.18 mm, preferably 0.12 mm.

Threads on both the second external threaded section 2 and the second internal threaded section 7 are line knuckle threads with 8 teeth per inch. Threads on both the first external threaded section 4 and the first internal threaded section 9 are different from those on the second external threaded section 2 and the second internal threaded section 7. The threads on the first external threaded section 4 and the first internal threaded section 9 are common TT threads with 5 teeth per inch, which threads meet the standards of the aluminum alloy drill pipe.

One end of the first internal threaded section 9 is connected to the second internal threaded section 7 by an internal transition section 8. One end of the first external threaded section 4 is connected to the second external threaded section 2 by an external transition section 3. A position of the internal transition section 8 corresponds to that of the external transition section 3, as shown in FIGS. 1 and 2.

The other end of the first internal threaded section 9 is provided with a second seal end face 10, and the first external threaded section 4 is provided outside thereof with a first seal end face 5 matched with the second seal end face 10, as shown in FIGS. 1 and 2. When the first joint 1 is connected to the second joint 6, the first seal end face 5 of the first joint 1 is fitted with the second seal end face 10 of the second joint 6 to realize the seal function.

The first joint 1 is a cylindrical or columnar pipe joint. The second joint 6 is made of steel, and the first joint 1 is made of aluminum alloy material. The first joint 1 has a strength far less than that of the second joint 6. For example, the aluminum alloy of which the first joint is made has the strength less than one half of the strength of the carbon steel of which the second joint is made.

During the assembly, the first external threaded section 4 and the first internal threaded section 9 are normally engaged with each other to achieve the expected connection strength between the pipe body and the joint. Meanwhile, the first seal end face 5 and the second seal end face 10 are pushed against each other to generate a contact pressure at the end faces to realize the sealed connection between the pipe body and the joint. Since the pitch diameter of the second external threaded section 2 is larger than that of the second internal threaded section 7, an interference occurs in the threaded connection between them. Since the strength of the aluminum alloy pipe body (first joint 1) is far less than that of the steel joint (second joint 6), the knuckle thread teeth of the pipe body (first joint 1) undergoes a plastic deformation, and a frictional resistance between the contacted teeth increases, so that the teeth may be bonded together under the local high temperature generated by the friction between the teeth. That is, during assembly and connection between the first joint 1 and the second joint 6, the threads at the pitch diameter portion of the second external threaded section 2 of the first joint 1 interfere with those at the pitch diameter portion of the second internal threaded section 7 of the second joint 6, and the threads at the pitch diameter portion of the second external threaded section 2 undergo a plastic deformation, and thus the engaged threads are bonded together and thread galling occurs.

Experiments show that a screwing-off torque of the aluminum drill pipe (first joint 1) and the steel joint (second joint 2) having such a structure is 1.5 to 2 times more than a screwing-on torque therebetween, so as to not only effectively ensure the properties of the connection and sealing between the aluminum alloy pipe body and the steel joint, but also eliminate the screwing off risk of the aluminum alloy pipe body and the steel joint during the usage.

The above descriptions are merely specific embodiments of the present invention, and may not be used to limit the scope of the present invention. Therefore, any replacement with an equivalent component, or any equivalent change and modification within the patent protection scope of the present invention, shall be covered by the patent. In addition, in the present invention, the technical features or the technical solutions can be freely combined with each other, and the technical features can be freely combined with the technical solutions.

What is claimed is:

1. A connection structure between an aluminum alloy drill pipe body and a steel joint of an aluminum alloy drill pipe, comprising a first joint located at an end of the aluminum alloy pipe body and a steel second joint;

wherein the first joint comprises a first external threaded section and a second external threaded section provided from outside to inside thereof, and a major diameter of the first external threaded section is smaller than that of the second external threaded section; and wherein a cylindrical second joint comprises a first internal threaded section which is able to be fitted with the first external threaded section and a second internal threaded section which is able to be fitted with the second external threaded section, and a pitch diameter of the second external threaded section is larger than that of the second internal threaded section.

2. The connection structure according to claim 1, wherein the pitch diameter of the second external threaded section is larger than that of the second internal threaded section by 0.08 mm to 0.18 mm.

3. The connection structure according to claim 1, wherein threads on both the second external threaded section and the second internal threaded section are knuckle threads.

4. The connection structure according to claim 1, wherein both the second external threaded section and the second internal threaded section are tapered thread sections.

5. The connection structure according to claim 1, wherein both the first external threaded section and the first internal threaded section are tapered thread sections.

6. The connection structure according to claim 1, wherein one end of the first internal threaded section is connected to the second internal threaded section by an internal transition section, one end of the first external threaded section is connected to the second external threaded section by an external transition section, and a position of the internal transition section corresponds to that of the external transition section.

7. The connection structure according to claim 6, wherein the internal transition section comprises a cylindrical transition section connected to the first internal threaded section and a tapered transition section connected to the second internal threaded section, and the external transition section is matched with the internal transition section in terms of a structure and size.

8. The connection structure according to claim 6, wherein the other end of the first internal threaded section is provided with a second seal end face, and the first external threaded section is provided outside thereof with a first seal end face matched with the second seal end face.

9. The connection structure according to claim 1, wherein the first joint is cylindrical or columnar, and a strength of aluminum alloy of which the first joint is made is less than that of carbon steel of which the second joint is made.

10. The connection structure according to claim 1, wherein when the first joint is connected to the second joint, threads of the second external threaded section of the first joint interfere with those of the second internal threaded section of the second joint, so that thread teeth of the second external threaded section undergo a plastic deformation, and the plastic deformation causes the engaged threads to be bonded together and thread galling occurs.

11. The connection structure according to claim 1, wherein threads of the first external threaded section of the first joint are normally engaged with those of the first internal threaded section of the second joint.

12. The connection structure according to claim 1, wherein after the first joint is connected to the second joint, a screwing-off torque between the first joint and the second joint is 1.5 to 2 times more than a screwing-on torque therebetween.

* * * * *